US008123501B2

(12) United States Patent
Gomilar et al.

(10) Patent No.: US 8,123,501 B2
(45) Date of Patent: Feb. 28, 2012

(54) TURBOCHARGER HOUSING, TURBOCHARGER AND A MULTI-TURBOCHARGER BOOSTING SYSTEM

(75) Inventors: Alexandre Gomilar, Morsang sur Orge (FR); Giorgio Figura, Epinal (FR); Pierre Barthelet, Remiremont (FR)

(73) Assignee: Honeywell International Inc., Morristown, NJ (US)

( * ) Notice: Subject to any disclaimer, the term of this patent is extended or adjusted under 35 U.S.C. 154(b) by 1094 days.

(21) Appl. No.: 11/632,006

(22) PCT Filed: Jul. 9, 2004

(86) PCT No.: PCT/EP2004/007601

§ 371 (c)(1), (2), (4) Date: Jul. 12, 2007

(87) PCT Pub. No.: WO2006/005355

PCT Pub. Date: Jan. 19, 2006

(65) Prior Publication Data

US 2008/0031750 A1 Feb. 7, 2008

(51) Int. Cl.
*F04B 17/00* (2006.01)

(52) U.S. Cl. ..... 417/407

(58) Field of Classification Search ..... 417/407; 415/111, 112, 175, 213.1, 214.1; 60/605.3, 60/612; 277/630, 926, 927, 928

See application file for complete search history.

(56) References Cited

U.S. PATENT DOCUMENTS

| | | | | |
|---|---|---|---|---|
| 1,966,855 | A * | 7/1934 | Gregg | 415/146 |
| 3,056,634 | A * | 10/1962 | Woollenweber, Jr. et al. | 384/287 |
| 3,090,546 | A * | 5/1963 | Woollenweber, Jr. | 415/111 |
| 3,180,568 | A * | 4/1965 | Oettle | 415/175 |
| 3,778,194 | A * | 12/1973 | Miller et al. | 417/407 |
| 3,825,311 | A | 7/1974 | Murray | |
| 5,076,765 | A * | 12/1991 | Yagi et al. | 417/407 |
| 5,890,881 | A * | 4/1999 | Adeff | 417/407 |
| 6,267,421 | B1 * | 7/2001 | Burton | 292/340 |
| 6,318,086 | B1 * | 11/2001 | Laustela et al. | 60/612 |
| 6,368,077 | B1 * | 4/2002 | Meyerkord et al. | 417/407 |
| 7,008,194 | B2 * | 3/2006 | Frankenstein | 417/407 |

FOREIGN PATENT DOCUMENTS

| | | | |
|---|---|---|---|
| DE | 3817617 | A1 | 7/1989 |
| EP | 0357246 | A2 | 3/1990 |
| EP | 0884453 | A1 | 12/1998 |
| WO | 2004046519 | A | 6/2004 |

* cited by examiner

*Primary Examiner* — Devon C Kramer
*Assistant Examiner* — Dnyanesh Kasture
(74) *Attorney, Agent, or Firm* — Brian J. Pangrle

(57) ABSTRACT

A turbocharger housing includes a main body for bearing a shaft for carrying a turbine wheel and a compressor wheel, and a seal portion to seal a clearance between the shaft and the turbocharger housing, where the seal portion is formed by an insert being fitted to the main body, where the insert includes a passage for supplying a fluid to the seal portion.

16 Claims, 5 Drawing Sheets

TURBOCHARGER HOUSING, TURBOCHARGER AND A MULTI-TURBOCHARGER BOOSTING SYSTEM

The invention relates to a turbocharger housing, a turbocharger and a multi-turbocharger boosting system.

Generally, a turbocharger is used for compressing air which is supplied to an internal combustion engine. A conventional turbocharger comprises a main body which supports a common shaft, one end thereof being equipped with a compressor wheel, whereas the other end thereof is equipped with a turbine wheel. The main body and the shaft having the turbine wheel as well as the compressor wheel are housed in a turbocharger housing. An exhaust gas from the internal combustion engine is supplied through a first inlet opening formed in the turbocharger housing to the turbine wheel, while fresh air is supplied through a second inlet opening formed in the turbocharger housing to the compressor wheel. The exhaust gas supplied to the turbine wheel rotates the common shaft, so that the fresh air is compressed by the compressor wheel.

U.S. Pat. No. 4,480,440 discloses a generic turbocharger housing of a turbocharger, the turbocharger comprises a main body for bearing a shaft for carrying a turbine wheel and a compressor wheel, and a seal portion to seal a clearance between the shaft and the turbocharger housing. A lubricant is supplied to the shaft bearing by means of a passage in the main body.

According to document U.S. Pat. No. 4,157,834, another turbocharger is known which comprises one or more conventional sealing portions each comprising a circumferential groove accommodating a sealing ring. Further sealing arrangements are disclosed in the prior art documents EP-A1-1245793, EP-A2-1130220 and WO-A2-02083593.

The object of the invention is to provide a turbocharger housing, a turbocharger and a multi-turbocharger boosting system, in which the sealing arrangement is improved with respect to the function and the manufacturing thereof.

According to the invention, the object is achieved by a turbocharger housing having the features of claim 1, by a turbocharger having the features of claim 9, and by a multi-turbocharger boosting system having the features of claim 13. Preferable embodiments of the invention are set forth in the dependent claims.

According to one aspect of the invention, the turbocharger housing comprises a main body for bearing a shaft for carrying a turbine wheel and a compressor wheel, and a seal portion for sealing a clearance between the shaft and the turbocharger housing, the seal portion being formed by an insert being fitted to the main body, wherein the insert comprises a passage for supplying a fluid to the seal portion. Advantageously, the passage within the insert is easy to manufacture, since the insert is a separate member which is attachable to and removable from the main body. It is to be noted that the main body generally is a die cast part, but it is not necessary to take complicated manufacturing steps for providing the passage within the main body, since the passage is not a part of the main body.

According to one embodiment according to this aspect of the invention, the seal portion of the insert is opposed to a seal bushing provided on the shaft, wherein the seal bushing supports a first piston ring, and the passage supplies the fluid to one side of the first piston ring. Advantageously, a pressure acting on this one side of the first piston ring is adjusted by the supplied fluid so that a predetermined pressure difference between this one side of the first piston ring and another side of the first piston ring can be decreased. Preferably, the fluid is supplied to a compressor wheel side of the first piston ring, thereby increasing the pressure on the compressor wheel side of the first piston ring so that there is no oil leakage from a main body side of the first piston ring toward the compressor wheel side.

According to the embodiment of this aspect of the present invention, the seal bushing preferably supports a second piston ring and the passage supplies the fluid in a space formed between first and second piston rings. Thereby, the same advantages as in the preceding embodiment are obtained.

According to another aspect of the present invention, the above-mentioned turbocharger housing is used in a first turbocharger of a multi-turbocharger boosting system. The multi-turbocharger boosting system furthermore comprises a second turbocharger, wherein the passage of the first turbocharger communicates with a compressor output and/or a turbine input of said second turbocharger. Preferably, the first turbocharger and the second turbocharger are connected in parallel. Advantageously, the second turbocharger can be used as a fluid source for supplying the fluid to the passage of the first turbocharger.

In the following, the invention with its function, effects and advantages will be explained by embodiments as non-restrictive examples with reference to the enclosed drawings in which FIG. 1 shows a cross-sectional view of main parts of a turbocharger according to a first embodiment of the present invention;

In the following, the currently preferred embodiments are explained on the basis of the drawings.

First Embodiment

Figure 1:
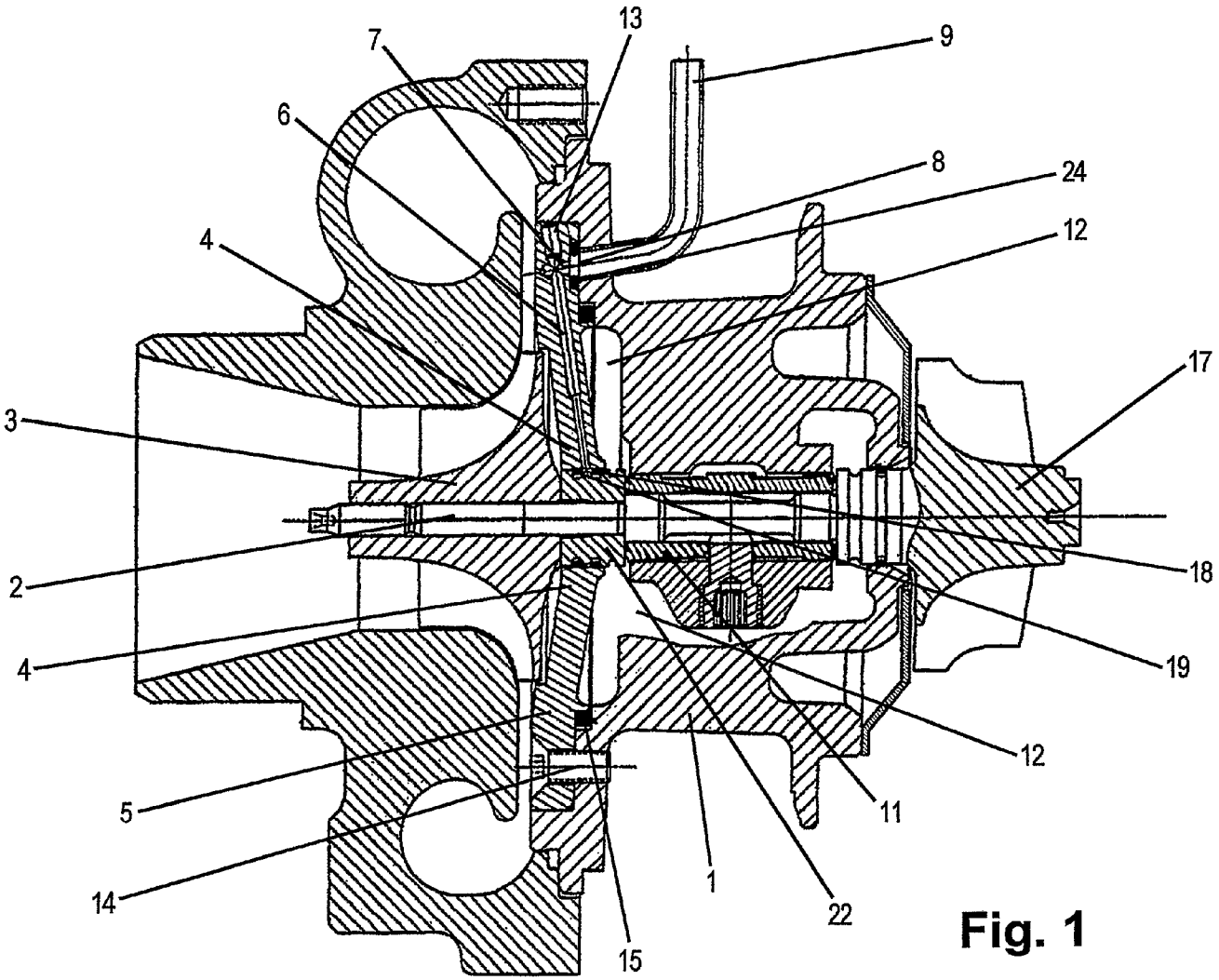
Figure 2:
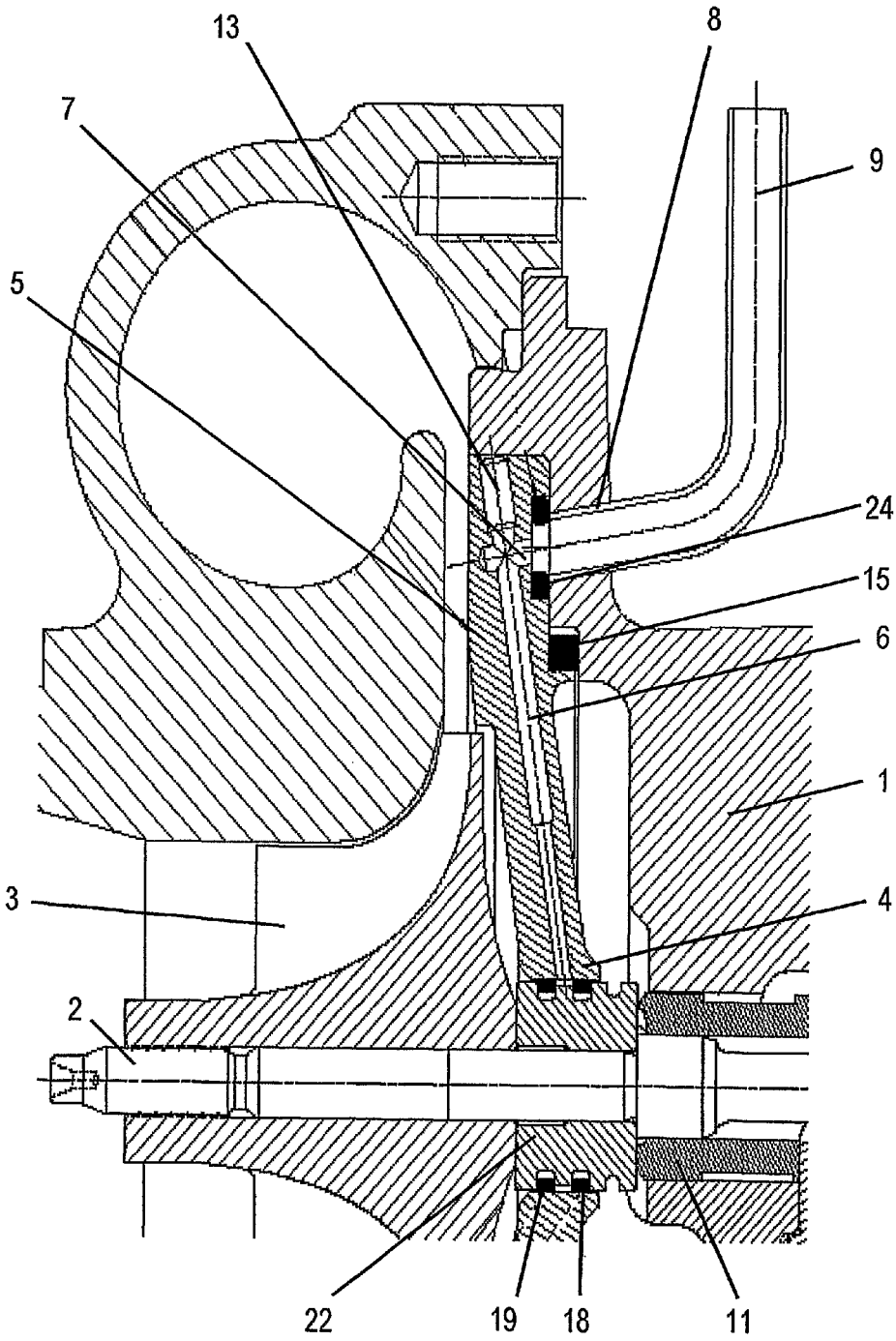
FIG. 2 shows an enlarged view of a cross-sectional view of the main parts of the turbocharger according to the first embodiment of the present invention.

The essential parts of a turbocharger according to a first embodiment of the invention are illustrated in FIGS. 1 and 2. Some parts of the turbocharger housing and the particular construction of the turbocharger parts are not shown in detail. The turbocharger comprises a compressor wheel 3 and a turbine wheel 17 mounted on the opposite ends of a common shaft 2. The shaft 2 is freely rotatable in a bearing provided in a main body 1 of the turbocharger housing. The bearing 11 is lubricated with a lubricant. In this embodiment, the lubricant is an engine oil which is supplied from an oil circuit (not shown) of a combustion engine, to which the turbocharger is assembled. The oil is supplied to the middle of the main body 1 and flows to a space 12 at the end of the main body 11 before it is discharged to the oil circuit of the combustion engine.

The oil must not enter a clearance between the shaft 2 and the main body 1 and leak out to the compressor wheel 3, which would contaminate the intake air of the combustion engine. To avoid such a leaking, a sealing arrangement is provided for. The sealing arrangement according to the present invention comprises an insert 5, a shaft bushing 22, and at least two piston rings, namely a first piston ring 18 and a second piston ring 19. The insert 5 is a substantially ring-shaped member fitted to the main body 1 at the compressor wheel side, thereby closing the main body 1. An inner circumference of the insert 5 forms a seal portion 4 for sealing a clearance between the shaft 2 and the turbocharger housing. The shaft 2 is passed through the seal portion 4 of the insert 5. The shaft bushing 22 is directly fitted to the shaft 2 at a predetermined position so that the shaft bushing 22 faces the seal portion 4 of the insert 5. The shaft bushing 22 has at least two grooves on its outer circumference for supporting the mating piston rings 18, 19. The piston rings 18, 19 are positioned on the outer circumference thereof in a sealing contact with the seal portion 4 of the insert 5. The sealing arrangement prevents the oil supplied to the main body 11 from leaking out to the compressor wheel 3 which otherwise would contaminate the intake air of the combustion engine.

A critical situation occurs at low compressor wheel speeds and mostly during operation modes in which there is almost no rotation of the compressor wheel 3. In this case, the pressure generated by the compressor wheel 3 is quite low, while the oil pressure within the space 12 is maintained on a high level. Thereby, a pressure difference exists between both sides of the piston rings 18, 19, i.e. between the compressor wheel side of the piston rings 18, 19 and their side opposed thereto, respectively. The pressure difference acts on the piston rings 18, 19 and tends to cause an oil leakage from the space 12 to the compressor wheel 3.

As a counter-measure, the insert 5 provides at least one passage 6, 7 which opens in a space between the two piston rings 18, 19 in order to communicate the space between the piston rings 18, 19 with the air outside the turbocharger, i.e. the passage supplies air outside the turbocharger to the space between the piston rings 18, 19. Thereby, the pressure within the space between the piston rings 18, 19 is increased so that the respective pressure differences acting on the piston rings 18, 19 are decreased. As a result, there is no oil leakage from the space 12 toward the compressor wheel 3.

The details of the passage are shown in FIG. 2. The passage is formed by a radial bore 6 and an axial bore 7 through the insert 5. As shown in FIG. 2, the radial bore 6 at the outer circumference is closed by a male thread 13. The radial bore 6 intersects the axial bore 7 which opens at the plane surface at the main body side of the insert 5 to form an inlet opening. The axial bore 7 in the insert 5 is aligned to a corresponding outlet opening 8 in the main body 1. Into the outlet opening 8 of the main body 1, a fluid feeding passage or a pipe 9 is fitted which leads to the outside of the turbocharger. The interface between the axial bore 7 of the insert 5 and the fluid feeding passage 9 is sealed by an O-ring 24.

Advantageously, the passage 6, 7 within the insert 5 is easy to manufacture, because the insert 5 is a separate member which is attachable to and removable from the main body 1. It is to be noted that the main body 1 generally is a die cast part, but it is not necessary to take complicated manufacturing steps for providing the passage 6, 7 within the main body 1, since the passage is not a part of the main body 1. Preferably, the insert 5 is made of aluminum. As a further advantage, the insert 5 additionally has the function of a backplate at the compressor side of the turbocharger, so that no additional part is necessary for forming the passage 6, 7.

In FIG. 1, the attachment of the insert 5 to the main body 1 is shown in more detail. The insert 5 is fixed to the main body 1 by means of screws 14 which are circumferentially arranged at a plane face of the insert 5. The plane face of the insert 5 at the main body side is provided with a portion for supporting an O-ring 15. The O-ring 15 seals the interface between the insert 5 and the main body 1 to avoid oil leakage from the space 12 to the outside.

Second Embodiment

A turbocharger according to a second embodiment is described below on the basis of FIGS. 3 through 6. Mainly, the differences between the turbocharger according to the first embodiment and the turbocharger according to the second embodiment are described below.

Figure 5:
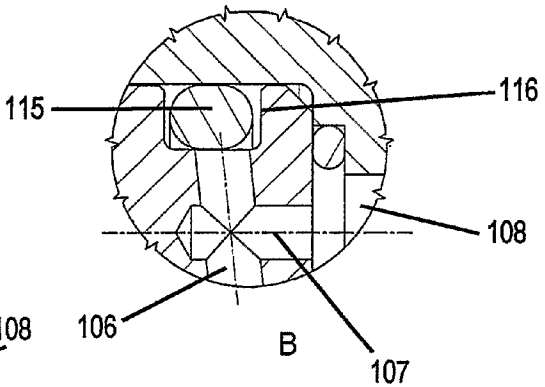
FIG. 5 shows a detail of the insert of the turbocharger according to the second embodiment of the present invention.
Figure 4:
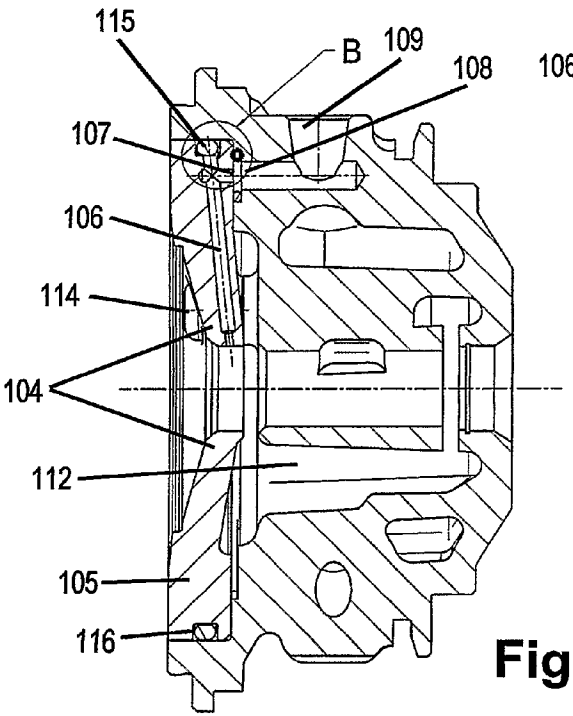
FIG. 4 shows a cross-sectional view of an insert and a main body of the turbocharger according to the second embodiment of the present invention.

Some details of a main body 101 and an insert 105 of the turbocharger according to the second embodiment are shown in FIGS. 4 and 5. The radial bore 106 of the insert 105 is communicated via an axial bore 107 with a corresponding outlet opening 108 in the main body 101 which leads to a fluid feeding port 109. The radial bore 106 opens at its other end in a space between piston rings 118 and 119.

Advantageously, the fluid feeding port 109 is universally connectable with various fluid sources. For instance, the fluid feeding port 109 is connectable to a compressor output and/or a turbine input of the turbocharger. Alternatively, the fluid feeding port 109 is connectable with a space where the turbine wheel 117 or the compressor wheel 103 of the turbocharger is located. Unlike in the first embodiment, the passage 106, 107 within the insert 105 is not necessarily communicated with the air outside the turbocharger, but the passage 106, 107 is communicatable with various fluid sources from the turbocharger and the engine environment.

Figure 3:
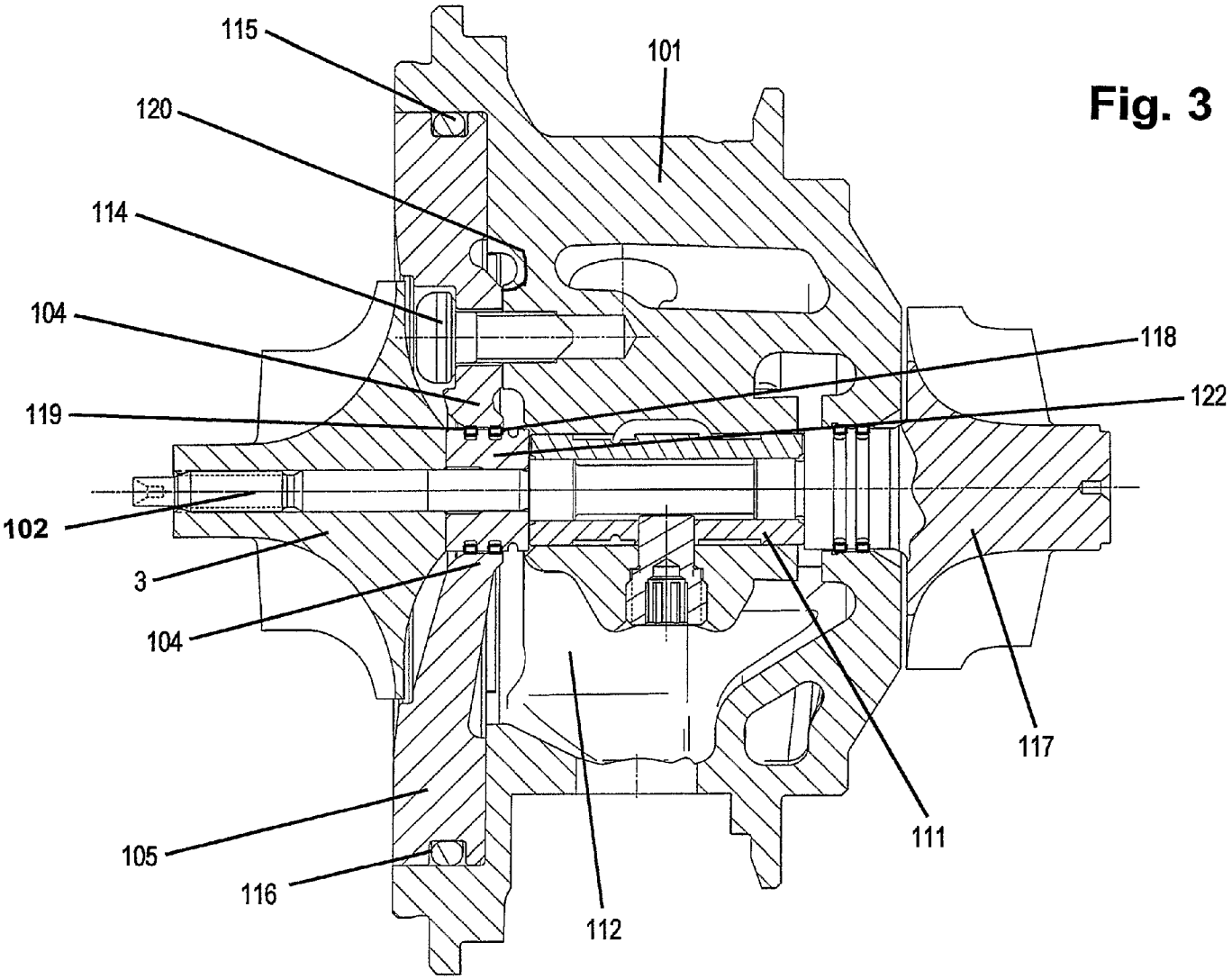
FIG. 3 shows a cross-sectional view of main parts of a turbocharger according to a second embodiment of the present invention.
Figure 6:
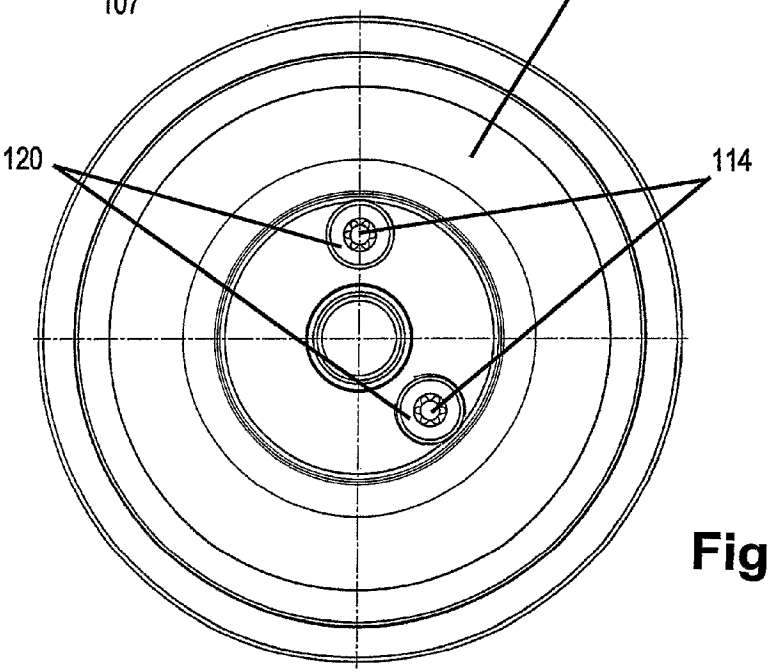
FIG. 6 shows a front view of the insert of the turbocharger according to the second embodiment of the present invention.

A further detail of the attachment of the insert 105 to the main body 101 is shown in FIGS. 3, 4 and 6. Preferably, the insert 105 is attached to the main body 101 by means of screws 114. As can be gathered from the plane view in. FIG. 6 in combination with the sectional view in FIG. 3 of the insert 105, the plane surface of the insert 105 at the main body side has protrusions 120 protruding from the plane surface. The screws 114 are arranged within the protrusions 120. Thereby, the insert 105 can reliable be fitted to the main body 101 without deforming the insert 105 by the attachment of the screws 114.

As further shown in FIG. 4 and in particular in the detailed view of FIG. 5, the interface between the insert 105 and the main body 101 is a sealed O-ring 115 which is accommodated into a groove 116 along the outer circumference of the insert 105. At the same time, the radial 106 bore of the insert 105 is sealed by this O-ring 115, and the number of O-rings is reduced compared to the first embodiment.

Third Embodiment

Figure 7:
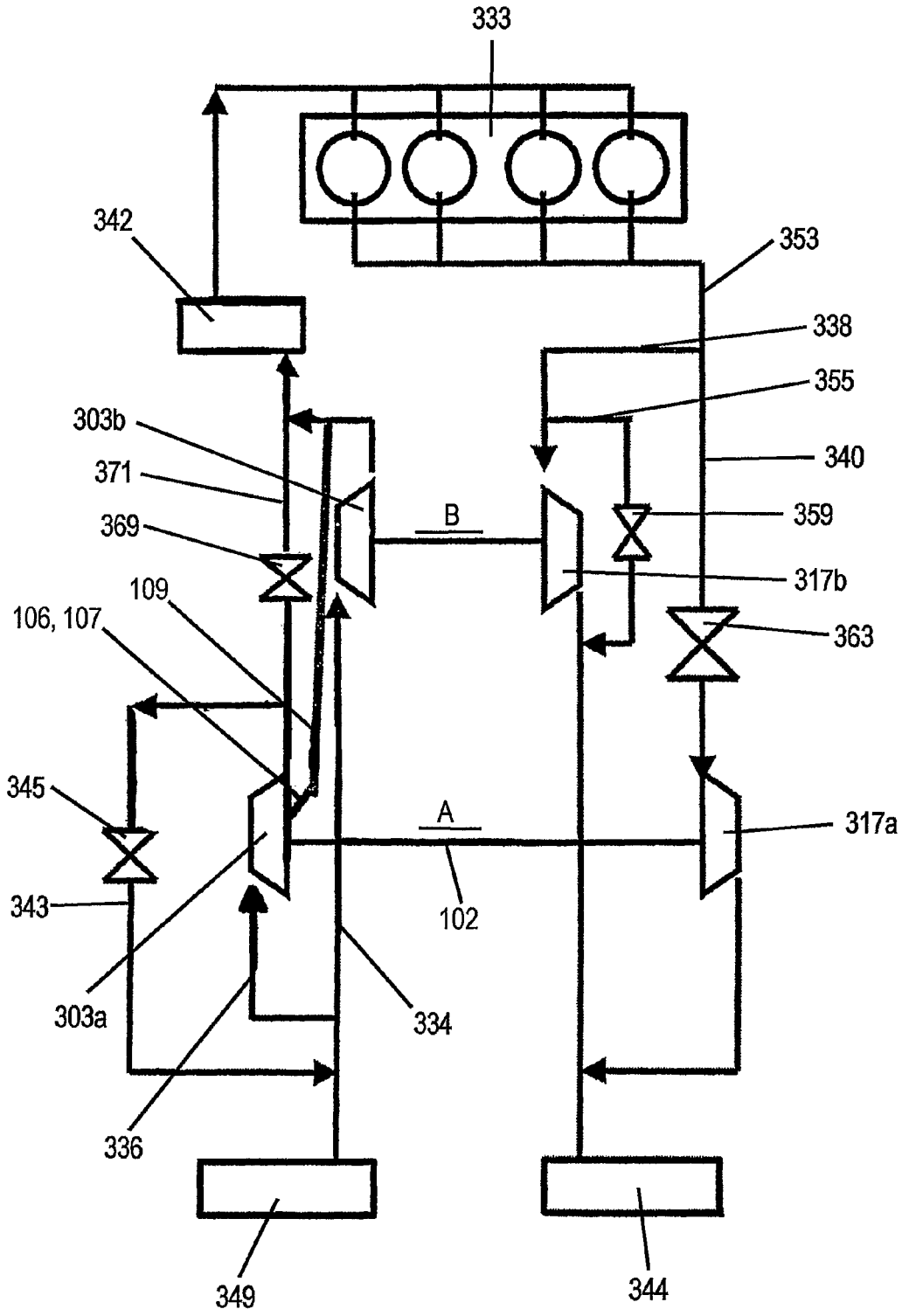
FIG. 7 shows a concept of a multi-turbocharger boosting system according to a third embodiment of the present invention.

The turbocharger according to the second embodiment is preferably used in a multi-turbocharger boosting system shown in FIG. 7. The multi-turbocharger boosting system comprises a turbocharger A according to the second embodiment as a first turbocharger, and furthermore a second turbocharger B, wherein the two turbochargers A and B are generally connected in parallel in relation to an internal combustion engine. Advantageously, the second turbocharger is used as a fluid source for supplying the fluid to the passage of the first turbocharger.

The second turbocharger B preferably comprises a free floating turbine 317*b* at its turbine side, whereas the first turbocharger A is equipped with a variable geometry turbine 317*a*. The turbines 317*a* and 317*b* and respective compressors 303*a* and 303*b* are connected in parallel. According to the layout, fresh air is fed in parallel to each of the compressors by means of a first fresh air conduit 334 and second fresh air conduit 336 and the air discharged from the compressors is guided through an intercooler 342 to the intake side of the internal combustion engine 333. At the turbine side of the layout, the exhaust gas from the engine 333 is fed through a first exhaust conduit 338 and a second exhaust conduit 340 branching from a conduit or piping 353 to the first and second turbine 303*a* and 303*b*, respectively, and the exhaust discharged from the parallel turbines is guided to a catalyst 344.

In the multi-turbocharger boosting system shown in FIG. 7, the first compressor A is provided with an air re-circulation system using air flow regulating means for adjusting the amount of the re-circulated air. The re-circulation system in this embodiment includes a by-pass conduit 343 with a butterfly valve 345 for adjusting the air mass-flow recirculated back into the second fresh air conduit 336 connecting the inlet of the first compressor 303*a* with an air filter 349.

The multi-turbocharger boosting system further comprises an additional butterfly valve 369 arranged in the conduit 371 connecting the first compressor 303*a* with the intercooler 342 between the merging point of the by-pass conduit 343 downstream of the first compressor 303*a* and the merging point of the second compressor 303*b* in the conduit 371.

At the turbine side of the multi-turbocharger boosting system, there is provided a bypass passage 355 with a corresponding waste gate valve 359. A butterfly or throttle valve 363 is arranged in the second exhaust conduit 340.

The multi-turbocharger boosting system according to FIG. 7 allows a highly efficient function of the internal combustion engine at low, medium and high rotational speeds of the internal combustion engine.

At a low rotational speed of the internal combustion engine 333, which means at about 1000-2000 rpm, the exhaust gas supplied through the exhaust conduit or piping 353 drives the free floating turbine 317*b* of the second turbocharger B. The butterfly valve 363 is closed or nearly closed so as to reduce the exhaust gas flowing into the first turbine 317*a*, thereby ensuring an idling rotation of the first turbocharger A so as to merely avoid oil leakage from the bearing system thereof. Under this condition, the speed of the second turbocharger B is controlled by means of the waste gate valve 359. At this stage, the second turbocharger B works normally to supercharge the engine 333.

At the low rotational speed, the butterfly valve 345 is open so that a re-circulation at the first compressor 303*a* is achieved. Due to the particular design of the layout, during the re-circulation, the pressure in the first compressor 303*a* can be lowered so that the trust load becomes less important and the reliability is improved.

The additional butterfly valve 369 remains closed and the second compressor 303*b* works normally to supercharge the engine 303.

In the range of a medium rotational speed of the internal combustion engine, which means at about 2000-2500 rpm, the butterfly or throttle valve 363 opens progressively so as to regulate the pressure before the first turbine 317*a* and the exhaust gas flow drives the first turbocharger A. At the same time, the butterfly valve 345 is progressively closed in order to balance the power between the first compressor 303*a* and the first turbine 317*a*, so that by operation of the butterfly valve 345, the speed of the first turbocharger A can be regulated.

In the range of a high rotational speed of the internal combustion engine, which means at about 2500-4000 rpm, the butterfly valve 363 is completely or almost completely open, wherein the speed of the first turbine 317*a* is regulated by means of the waste gate valve 359. During this operation, the additional butterfly valve 396 is open and the butterfly valve 345 is totally closed.

In the above-mentioned mode of operation at a low rotational speed, the butterfly valve 363 can be closed or nearly closed without thereby causing an oil leakage.

The advantages of the third embodiment are apparent with respect to the structure of the first turbocharger which is similar to the turbocharger shown in FIG. 3. Although the pressure behind the first compressor 303*a* of the first turbocharger A becomes quite low, the pressure drop at the outer piston ring 119 is decreased by ventilating the space between the outer and inner piston rings 119 and 118 by air at normal atmospheric pressure. The inner piston ring 118 positioned between the radial bore 106 and the bearing 111 is also subject to a reduced pressure difference so that an oil leakage to the compressor side of the first turbocharger A can efficiently be avoided even if the rotation of the first turbocharger is stopped.

Modifications

According to the first and second embodiment shown in FIGS. 1 and 3, the outer piston rings 19 and 119, respectively, and their corresponding grooves can be omitted, whereas the merging point of the radial bore 6 and 106, respectively, is to be arranged close to a single piston ring 18, 118 at the corresponding groove.

According to the first and second embodiment shown in FIGS. 1 and 3, the passages 6, 7 and 106, 107 are completely formed inside the inserts 5 and 105, respectively. It is possible that the passage is at least partially formed at an outer surface of the insert. For instance, the passage can be formed by a groove on the outer surface of the insert, wherein the. groove is closed by an opposed face of the main body when the insert is fitted to the main body.

It is obvious to the skilled person that the present invention is not restricted by the embodiments illustrated herein. The scope of the present invention is rather defined by the appended claims.

The invention claimed is:

1. A turbocharger housing comprising a main body that bears a shaft that carries a turbine wheel and a compressor wheel, a seal portion that seals a clearance between the shaft and the turbocharger housing, the seal portion disposed axially between a main body space and a compressor wheel space, and an O-ring, characterized in that said seal portion is formed by an insert fitted to the main body, wherein said insert comprises a passage that supplies a fluid to said seal portion wherein said passage comprises a partial bore that intersects a through bore, wherein said partial bore comprises an open end that faces said main body, and wherein said through bore comprises an open end at an inner circumference of said insert and a sealable end at an outer circumference of said insert that faces a radial surface of said main body wherein said insert comprises an annular groove along said outer circumference of said insert, said O-ring seated in said annular groove and making direct contact with said sealable end of said through bore thereby sealing said sealable end of said through bore.

2. A turbocharger housing according to claim 1, wherein said seal portion formed by said insert is opposed to a seal bushing provided on the shaft, wherein said seal bushing supports a first piston ring, and said passage supplies the fluid to one side of said first piston ring.

3. A turbocharger housing according to claim 2, wherein said seal bushing supports a second piston ring and said passage supplies the fluid to a space formed between said first and second piston rings.

4. A turbocharger housing according to any one of claims 1 to 3, wherein said through bore comprises a radial bore and wherein said partial bore comprises an axial bore.

5. A turbocharger housing according to claim 1, wherein the insert comprises, on a plane surface thereof which faces the main body, protrusions for passing screws therethrough for fixing the insert to the main body.

6. A turbocharger housing according to claim 1, wherein said insert forms a backplate for the compressor wheel.

7. A turbocharger housing according to claim 1, wherein said insert is a ring-shaped member, the inner circumference of which forms said seal portion.

8. A turbocharger housing according to claim 1, wherein said open end of said partial bore comprises an inlet opening which communicates with an outlet opening of another passage formed in the main body.

9. A turbocharger comprising a turbocharger housing according to claim 1.

10. A turbocharger according to claim 9, wherein the passage communicates with air outside the turbocharger.

11. A turbocharger according to claim 9, wherein the passage communicates with a compressor output and/or a turbine input of the turbocharger.

12. A turbocharger according to claim 9, wherein said passage communicates with a space where said turbine wheel or said compressor wheel of the turbocharger is located.

13. A multi-turbocharger boosting system comprising at least a first turbocharger and a second turbocharger, wherein at least the first turbocharger is a turbocharger according to claim 9, wherein the passage thereof communicates with a compressor output and/or a turbine input of said second turbocharger.

14. A multi-turbocharger boosting system according to claim 13, wherein the first turbocharger and the second turbocharger are connected in parallel.

15. A turbocharger according to claim 1 wherein said sealable end of said through bore comprises threads.

16. A turbocharger according to claim 1 wherein, said passage provides pressurized fluid that reduces leakage of shaft lubricant from said main body space to said compressor wheel space.

* * * * *